US007434436B2

(12) United States Patent
Münker et al.

(10) Patent No.: US 7,434,436 B2
(45) Date of Patent: Oct. 14, 2008

(54) MULTI-PART ROLL STAND FOR EDGERS IN ROLLING MILLS

(75) Inventors: Jochen Münker, Kreuztal (DE); Hendrik Langer, Schmallenberg (DE); Stefan Wendt, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/580,788

(22) PCT Filed: Oct. 22, 2004

(86) PCT No.: PCT/EP2004/011972

§ 371 (c)(1),
(2), (4) Date: May 26, 2006

(87) PCT Pub. No.: WO2005/061138

PCT Pub. Date: Jul. 7, 2005

(65) Prior Publication Data

US 2007/0101791 A1 May 10, 2007

(30) Foreign Application Priority Data

Nov. 27, 2003 (DE) ..... 103 55 977

(51) Int. Cl.
*B21B 31/02* (2006.01)

(52) U.S. Cl. ..... 72/237; 72/455; 100/214

(58) Field of Classification Search ..... 72/237, 72/455; 100/214; 83/859
See application file for complete search history.

(56) References Cited

U.S. PATENT DOCUMENTS

| | | | | |
|---|---|---|---|---|
| 679,413 | A * | 7/1901 | Bunker | 72/244 |
| 3,368,380 | A * | 2/1968 | Pawalkat | 72/237 |
| 3,895,512 | A | 7/1975 | Sack et al. | |
| 4,537,056 | A * | 8/1985 | Heffentrager | 72/238 |
| 4,768,366 | A * | 9/1988 | Sendzimir | 72/242.4 |
| 5,085,069 | A | 2/1992 | Walters et al. | |
| 5,394,723 | A * | 3/1995 | Benz | 72/163 |
| 5,732,590 | A * | 3/1998 | Heitze et al. | 72/455 |

FOREIGN PATENT DOCUMENTS

EP 0 703 016 3/1996

* cited by examiner

*Primary Examiner*—Dmitry Suhol
(74) *Attorney, Agent, or Firm*—Friedrich Kueffner

(57) ABSTRACT

A roll stand for edgers in rolling mills. The roll stand is formed of several pieces, including two crossheads and four longitudinal bars as main components, as well as one respective common cruciform junction point for the crosshead and the longitudinal bars, which is located at the ends of the longitudinal bars. Pretensioned through bolts that act as a joint are used at least at the top ends of the longitudinal bars.

11 Claims, 5 Drawing Sheets

MULTI-PART ROLL STAND FOR EDGERS IN ROLLING MILLS

The invention concerns a multipart mill housing for edging stands in rolling mills, which consists of main components, such as crossheads and longitudinal beams, which are joined by bolts.

Mill housings for edging stands are usually cast constructions for holding the assemblies necessary for the edging process, such as assemblies for adjusting, assemblies for balancing, sets of edging rolls, gearing, motor, and the like.

Two-part cast constructions are known, in which the mill housing has a horizontal line of separation, and the two halves are joined with positive locking, e.g., by means of a shrink ring.

All cast variants have the disadvantage that large cast parts must be produced with a correspondingly great degree of difficulty and corresponding casting risk. Another disadvantage is that due to the high part weights, increased requirements must be placed on the production machines to be used. Accordingly, the choice of foundries and machining works is restricted, and this additionally results in commercial restrictions.

The type referred to at the beginning, which has also been realized in practice, is a multipart mill housing that has two crossheads and four longitudinal beams, which are joined by bolts.

The objective of the invention is to improve multipart edging stands in such a way that greater consideration is given to the area reduction of the housing window, the operating load, and the impact force (horizontal maximum force, under which the rolling stock is guided against the closed rolls of a vertical stand).

In accordance with the invention, this objective is achieved in a multipart embodiment of the main components, which consists of the two crossheads and the four longitudinal beams, by providing a common joint with a cruciform structure for the crosshead and the longitudinal beam at each of the upper and lower ends of the longitudinal beams, wherein prestressed through-bolts that act as joints are used at least at the upper ends of the longitudinal beams. These prestressed through-bolts guarantee a permanently secure connection by virtue of high prestressing. In this way, on the one hand, the bolt additional force remains low relative to the prestressing force, and, on the other hand, the pulling apart or expansion of lines of separation is avoided. The joint-like connection by prestressing also results in less area reduction of the housing window under load compared to a comparable edging stand with only two parts.

In addition, due to the special cruciform structure at the ends of the longitudinal beams, the stress level and the diffusion of stress in the longitudinal beams and/or the crosshead are optimized. These statements have been borne out by models based on the finite-element method. In addition, it is possible to find an optimum for the bolt prestressing, with which the design-related hole in the crosshead for holding the adjusting device for the tool is not significantly deformed in conformity with narrow predetermined tolerances.

In accordance with a refinement of the invention, each crosshead is realized as a single piece and can be mounted on a bottom plate.

It is also advantageous for the crossheads to form an assembly by positive locking with the longitudinal beams and with the prestressed through-bolts.

In addition, the production of the mill housing is favorably affected if at least the crossheads and the longitudinal beams are made of cast materials.

Furthermore, the statics of the system are improved if the through-bolts are arranged in pairs symmetrically to the center plane.

Further improvement is achieved if, in addition to the through-bolts, screw bolts are arranged in pairs symmetrically with respect to the center plane.

In accordance with another refinement of the invention, the longitudinal beams are mounted in each crosshead by the cruciform structure, the through-bolts, and the screw bolts. The screw bolts can be screwed into threaded blind holes in the crosshead and can be arranged towards the outside of the mill housing.

The connections between the crosshead and longitudinal beams are preferably designed in such a way that the crosshead is provided with a cruciform pocket, which is engaged by an inner key form and an outer key form. The projections of the cruciform legs of the longitudinal beams contain holes for receiving the through-bolts and/or the screw bolts. The dimensions of the key forms depend on the design necessities of the crosshead, and the size of the key forms is designed to allow the prestressed through-bolts to be passed through two longitudinal beams past the components installed in the crosshead.

The outer cruciform leg or the inner cruciform leg each forms a slot form or a key form, which fit into each other when they lie opposite each other. This slot form and the key form are inserted into the matching cruciform pocket of the crosshead. The cruciform pocket of the crosshead has a corresponding slot form and key form, and this results in a positive-locking connection between the crosshead and longitudinal beams.

The cross-sectional contour of the longitudinal beam transverse to the cruciform legs in slot form or key form or to the pocket in the crosshead depends on the actual loads of the edging stand with respect to the operating force and the impact force and is variably dimensioned over the length of the longitudinal beam. The cross section essentially follows the shape of a beam of the same load.

In accordance with other features, the cross-sectional transitions in the crosshead and/or in the longitudinal beams are provided with radii of suitably matched size according to the operating force and impact force. This ensures uniform diffusion of stress.

The cruciform pockets of the crosshead and the cruciform key forms of each end of a longitudinal beam are provided with chamfers. The chamfers can be filled in with sealants, e.g., silicone. This prevents the penetration of dirt, water, and other foreign substances.

In accordance with another refinement of the invention, not only the through-bolts but also the screw bolts are designed as necked-down bolts and, like the through-bolts, have a heating hole, threaded ends and centering shoulders to facilitate assembly. All of the through-bolts and screw bolts are provided with a relatively long threaded end, which allows tractive controlled tightening with suitable prestressing tools, so that reliable control of the prestressing force is ensured.

The design described above can be modified by separating the crosshead into a crosshead upper part and a crosshead lower part and joining the upper part and lower part by means of a shrink ring, a flange joint or a connector.

Specific embodiments of the invention are illustrated in the drawings and are explained in greater detail below.

Figure 1:
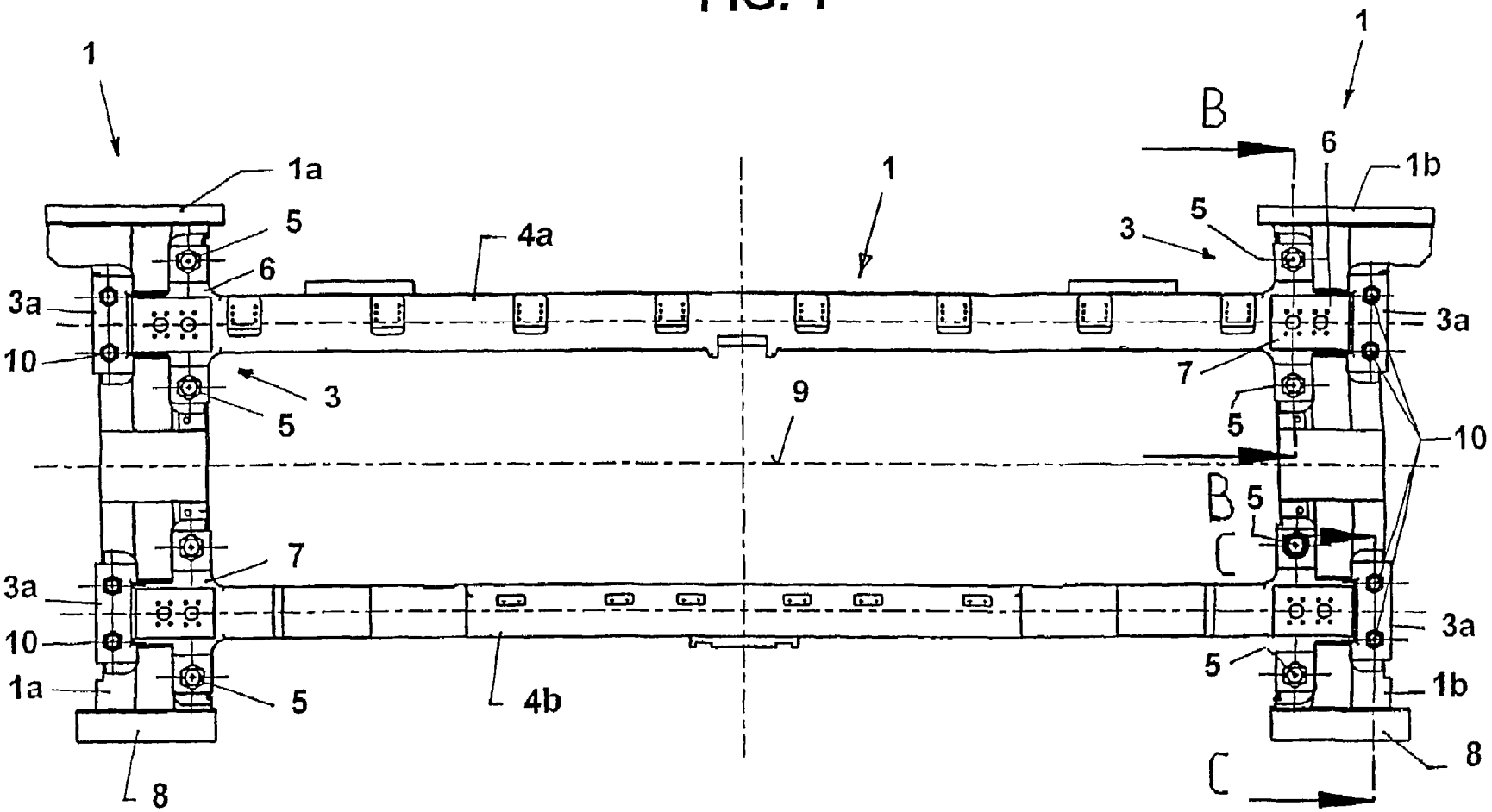
FIG. 1 shows a front elevation of the mill housing.

In accordance with FIG. 1, the main components 1 consist of two crossheads 1*a* and 1*b* and four longitudinal beams 4*a* and 4*b*. Joints 3 with covering parts 3*a* are formed at each transition to a crosshead 1*a*, 1*b*.

In the 6-part embodiment illustrated here, in which the main components 1 consist of two crossheads 1*a*, 1*b* and four longitudinal beams 4*a*, 4*b*, a cruciform structure 7 that consists of cruciform legs 11 or key forms 19 is formed at each end 6 of a longitudinal beam.

The joint between the crosshead 1*a*, 1*b* and the longitudinal beams 4*a*, 4*b*, each of which is supported on a bottom plate (not shown) below a crosshead base 8, is produced by through-bolts 5, which are prestressed and thus form a transverse joint that can expand in the material in the axial direction. The end 6 of the longitudinal beam is connected via the cruciform structure 7 with the crossheads 1*a*, 1*b* by means of screw bolts 10.

Tools, such as pairs of edging rolls or press blocks and the like, can be installed in the center plane 9.

A mill housing of this type is used for lateral edging, i.e., for reducing the width, of steel slabs with thicknesses of 150-300 mm at an input temperature of about 1,150° C. or higher and at rates of 1.5-6 m/s or aluminum slabs up to 600 mm in thickness at an input temperature of about 540° C. or higher.

Figure 2:
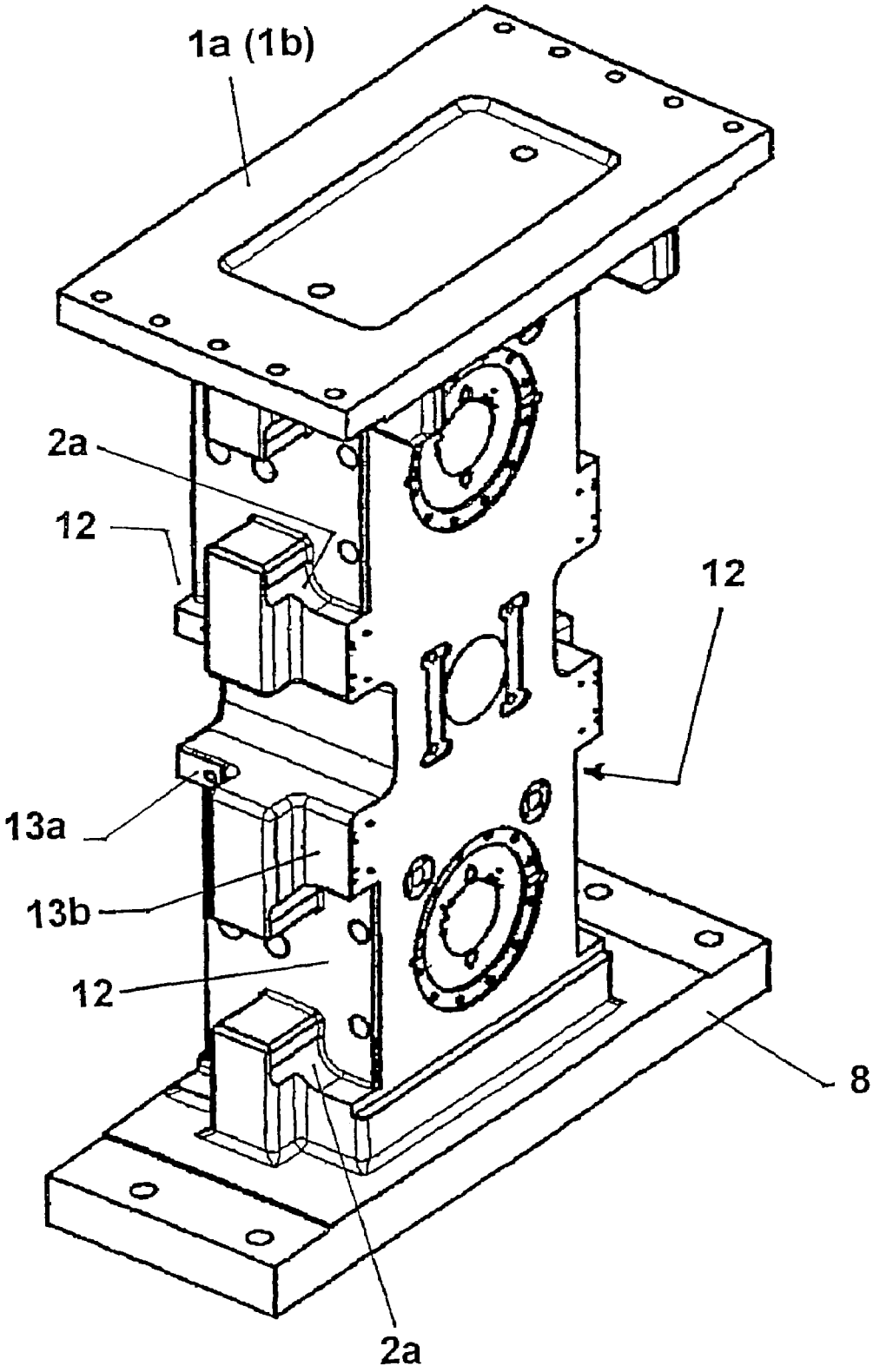
FIG. 2 shows a perspective view of the crosshead.

The following features are clearly shown in the crosshead 1*a*, 1*b* in FIG. 2: a cruciform pocket 12, cross-sectional transitions 2*a*, and an inner slot form 13*a* and outer slot form 13*b*.

Figure 3:
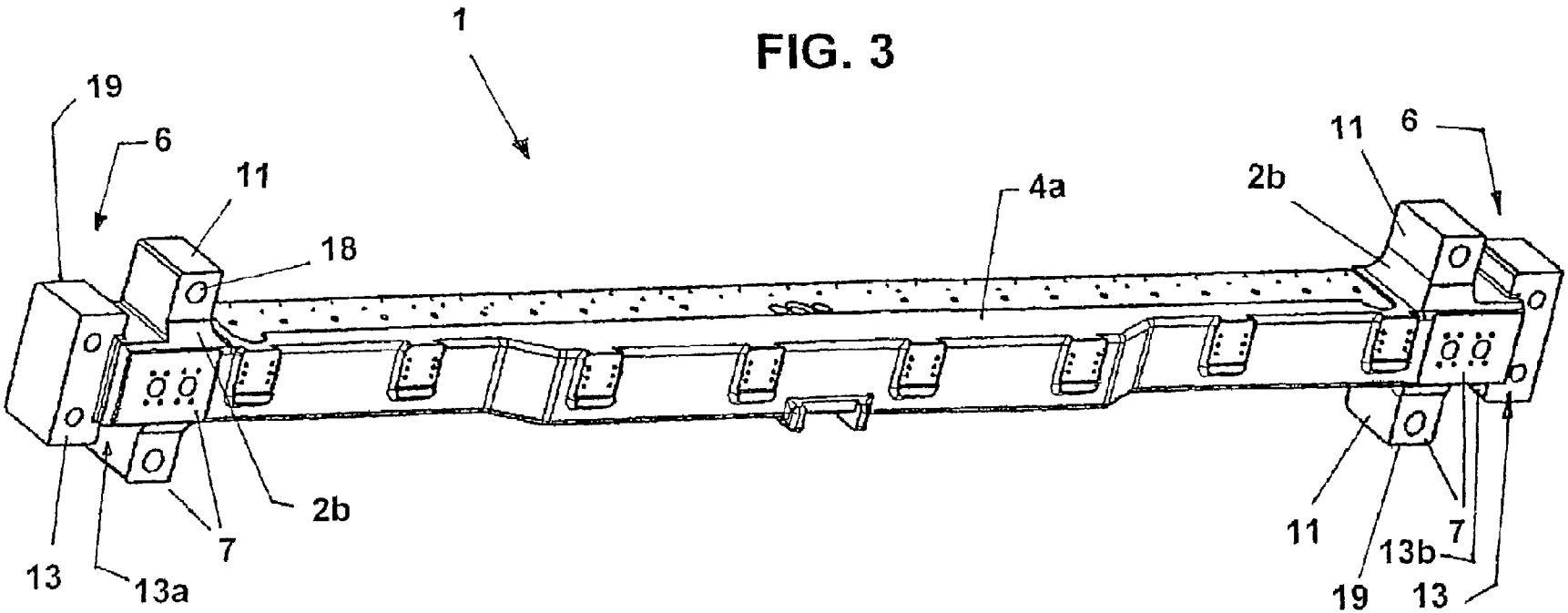
FIG. 3 shows a perspective view of an individual longitudinal beam.

Another main component 1 is the longitudinal beam 1*a*, 1*b* illustrated in FIG. 3. The ends 6 of the longitudinal beam 4*a* has key forms 19 arranged in the cruciform structure 7 with outer cruciform legs 13, inner slot forms 13*a*, outer slot forms 13*b*, and cruciform legs 11, which are provided with cross-sectional transitions 2*b* and holes 18 in the longitudinal beam 4*a*, 4*b*.

Figure 4:
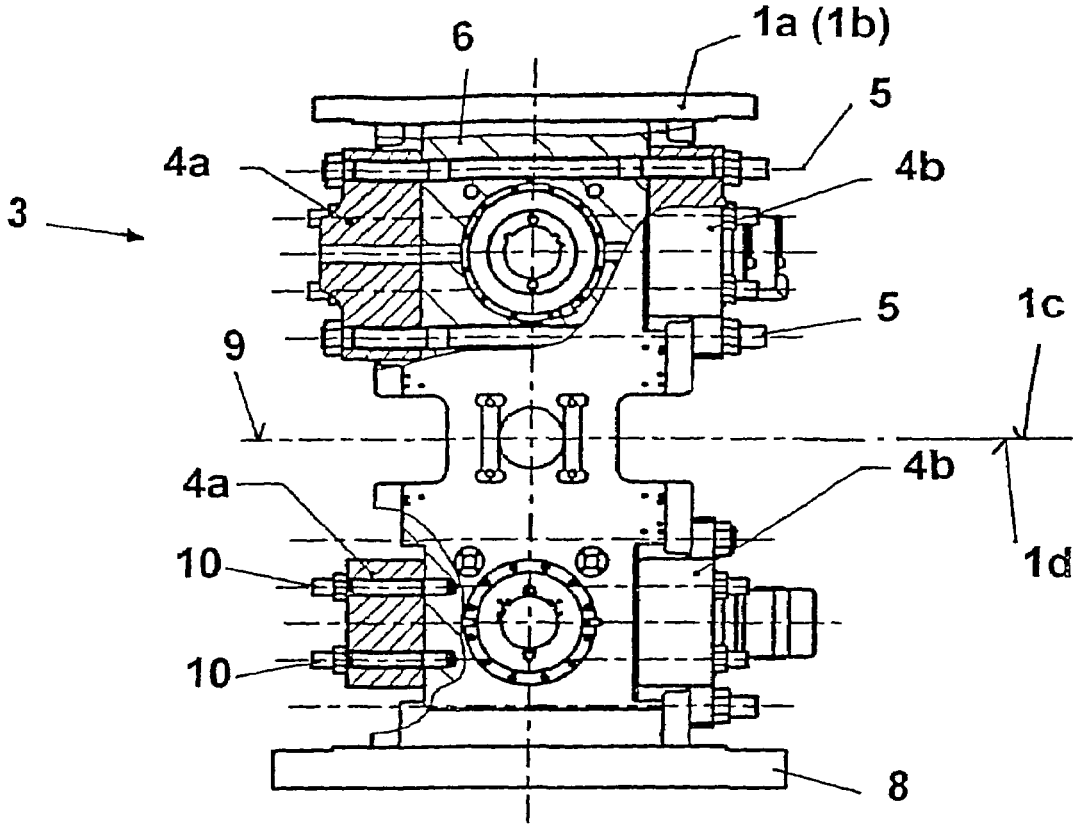
FIG. 4 shows a section B-B in the upper part in a front plane and a section C-C in the lower part in a rear plane.
Figure 5A:
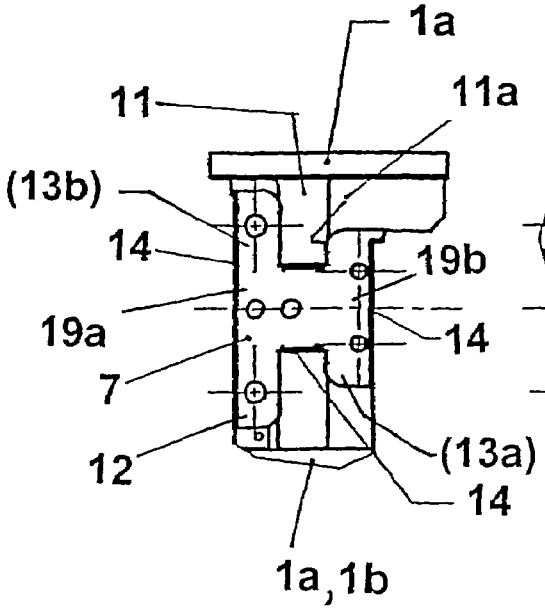
FIG. 5A shows a view of the cruciform structure in the crosshead.
Figure 5B:
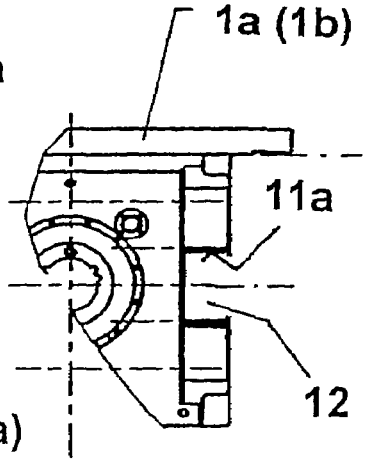
FIG. 5B shows a side view corresponding to FIG. 5A.

The crossheads 1*a*, 1*b* are mounted on the bottom plate below the crosshead base 8, and the joints 3 are produced as follows with the cruciform structure 7 in accordance with FIGS. 4, 5A and 5B:

The through-bolts 5 (FIG. 4, upper part) join each crosshead 1*a*, 1*b* with the longitudinal beams 4*a* and 4*b*.

The screw bolts 10 (FIG. 4, lower part) join each crosshead 1*a*, 1*b* with the longitudinal beams 4*a*, 4*b* and are each screwed into a threaded blind hole of the crosshead 1*a*, 1*b*.

The crosshead 1*a*, 1*b* (FIGS. 5A and 5B) forms an assembly by positive locking with the longitudinal beams 4*a*, 4*b* together with the through-bolts 5 and the screw bolts 10. The through-bolts 5 and the screw bolts 10 are arranged in pairs symmetrically to the center plane 9.

The crosshead 1*a*, 1*b* is provided with a pocket 12 and an outer cruciform leg 11, which form the cruciform structure 7 and interact with inner key forms 19*a*, outer key forms 19*b* of the longitudinal beam 4*a*, 4*b* (or pockets 12 of the crosshead 1*a*, 1*b*) and form the positive-locking connection. The cruciform inner (or outer) key form 19*a* and an outer (or inner) key form 19*b* are arranged for this purpose.

Cruciform pockets 12 can also be provided only in the crosshead 1*a*, 1*b*. These cruciform pockets 12 are engaged by cruciform key forms 19*a*, 19*b* of the longitudinal beams 4*a*, 4*b*.

Chamfers 14 are chamfered or beveled on the cruciform pockets 12 with cruciform legs 11, which have adjoining slot forms 11*a* (FIG. 5B) or key forms 19*a*, 19*b*. The chamfers 14 can be filled in with sealants, e.g., silicone, to prevent the penetration of dirt and/or water or other foreign substances.

Figure 8:
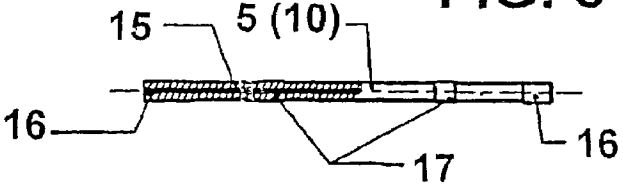
FIG. 8 shows a view of a through-bolt.
Figure 9:
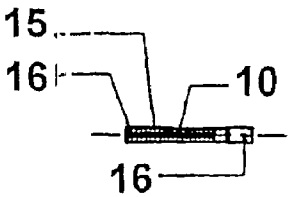
FIG. 9 shows a view of a screw bolt.
Figure 7:
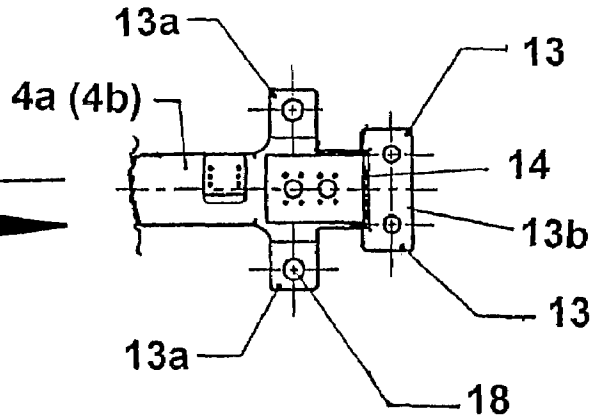
FIG. 7 shows a top view of the cruciform structure in the longitudinal beam in direction "A" (FIG. 6).
Figure 6:
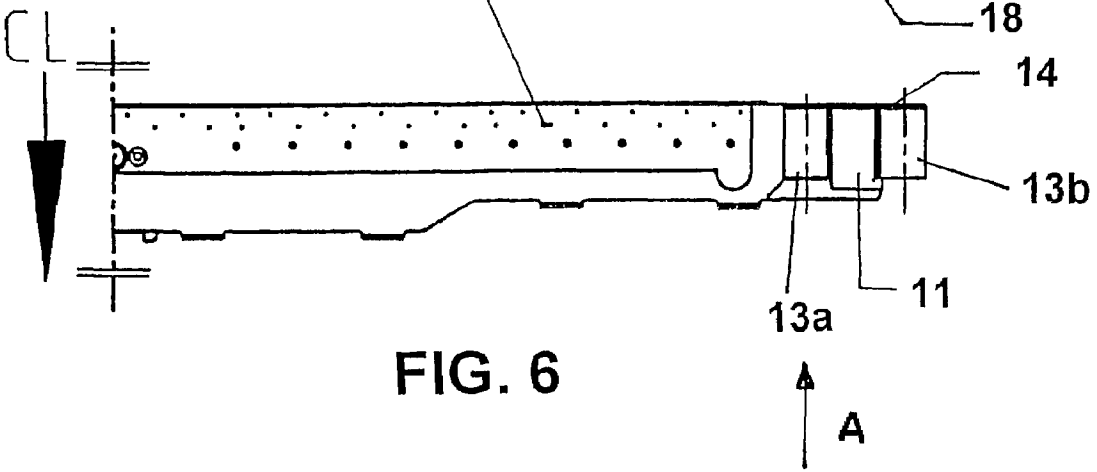
FIG. 6 shows a partial section through the end of a longitudinal beam.

The screw bolts 10 can be designed as necked-down bolts that same as the through-bolts 5 (FIGS. 8 and 9) and have heating holes 15, two threaded ends 16 and a centering shoulder 17 and pass through the holes 18.

Alternatively, the crosshead 1*a*, 1*b* is separated into a crosshead upper part 1*c* and a crosshead lower part 1*d* (FIG. 4), and the upper part 1*c* and lower part 1*d* are joined by means of a shrink ring, a flange joint or a connector (not shown).

LIST OF REFERENCE NUMBERS

1 main component
1*a* crosshead
1*b* crosshead
1*c* crosshead upper part
1*d* crosshead lower part
2*a* cross-sectional transition in the crosshead
2*b* cross-sectional transition in the longitudinal beam
3 joint
3*a* covering parts
4*a* longitudinal beam
4*b* longitudinal beam
5 prestressed through-bolt
6 end of a longitudinal beam
7 cruciform structure
8 crosshead base
9 center plane
10 screw bolt
11 cruciform leg
11*a* slot form
12 (cruciform) pocket in the crosshead
13 outer cruciform leg
13*a* inner slot form
13*b* outer slot form
14 chamfer
15 heating hole
16 threaded end
17 centering shoulder
18 hole
19 key form
19*a* inner key form
19*b* outer key form

The invention claimed is:

1. Multipart mill housing for edging stands in rolling mills, which consists of main components (1) made up of two crossheads (1*a*; 1*b*) and four longitudinal beams (4*a*; 4*b*), which are joined by bolts, wherein in a multipart embodiment of the main components (1), which consists of the two crossheads (1*a*; 1*b*) and the four longitudinal beams (4*a*, 4*b*), a common joint (3) with a cruciform structure (7) is provided for the crossheads (1*a*, 1*b*) and the longitudinal beams (4*a*, 4*b*) at each of upper and lower ends (6) of the longitudinal beams (4*a*, 4*b*), the cruciform structures bring integral with the longitudinal beams, wherein pretensioned through-bolts (5) that act as joints are used at least at the upper ends (6) of the longitudinal beams, wherein each of the crossheads (1*a*; 1*b*) is provided with a cruciform pocket (12), which is engaged by an inner key form (19*a*) and an outer key form (19*b*).

2. Mill housing in accordance with claim 1, wherein each crosshead (1*a*, 1*b*) is realized as a single piece and has a crosshead base (8) for mounting the crosshead on a bottom plate.

3. Mill housing in accordance with claim 1, wherein the crossheads (1*a*; 1*b*) form an assembly by positive locking with the longitudinal beams (4*a*; 4*b*) and with the pretensioned through-bolts (5).

4. Mill housing in accordance with claim 1, wherein at least the crossheads (1*a*; 1*b*) and the longitudinal beams (4*a*; 4*b*) are made of cast materials.

5. Mill housing in accordance with claim 1, wherein the through-bolts (5) are arranged in pairs symmetrically to a center plane (9).

6. Mill housing in accordance with claim 5, wherein in addition to the through-bolts (5), screw bolts (10) are arranged in pairs symmetrically to the center plane (9).

7. Mill housing in accordance with claim 6, wherein the longitudinal beams (4*a*; 4*b*) are mounted in each crosshead (1*a*, 1*b*) by the cruciform structure (7), the through-bolts (5), and the screw bolts (10).

8. Mill housing in accordance with claim 6, wherein not only the throughbolts (5) but also the screw bolts (10) are designed as necked-down bolts and, like the through-bolts (5), have a heating hole (15), threaded ends (16) and centering shoulders (17) to facilitate assembly.

9. Mill housing in accordance with claim 1, wherein cross-sectional transitions (2*a*; 2*b*) in the crossheads (1*a*; 1*b*) and/or in the longitudinal beams (4*a*, 4*b*) are provided with radii of suitably matched size according to the operating force and impact force.

10. Mill housing in accordance with claim 1, wherein the cruciform pockets (12) of the crossheads (1*a*; 1*b*) and the cruciform key forms (19) of each end (6) of a longitudinal beam are provided with chamfers (14).

11. Mill housing in accordance with claim 1, wherein each of the crossheads (1*a*; 1*b*) is seperated into a crosshead upper part (1*c*) and a crosshead lower part (1*d*), and the upper part (1*c*) and lower part (1*d*) are joined by means of a shrink ring, a flange joint, or a connector.

* * * * *